US008919935B2

(12) United States Patent
Stathem et al.

(10) Patent No.: US 8,919,935 B2
(45) Date of Patent: Dec. 30, 2014

(54) LIQUID SUPPLY

(75) Inventors: Ralph L. Stathem, Lebanon, OR (US); Mark C. Donning, Eugene, OR (US); David Olsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/696,547

(22) PCT Filed: May 10, 2010

(86) PCT No.: PCT/US2010/034272
§ 371 (c)(1),
(2), (4) Date: Nov. 6, 2012

(87) PCT Pub. No.: WO2011/142742
PCT Pub. Date: Nov. 17, 2011

(65) Prior Publication Data
US 2013/0050356 A1 Feb. 28, 2013

(51) Int. Cl.
*B41J 2/175* (2006.01)

(52) U.S. Cl.
CPC ..... *B41J 2/17596* (2013.01)
USPC ..... 347/85

(58) Field of Classification Search
CPC . B41J 2/17556; B41J 2/17523; B41J 2/17503
USPC ..... 347/85
See application file for complete search history.

(56) References Cited

U.S. PATENT DOCUMENTS

| | | | | |
|---|---|---|---|---|
| 5,159,348 | A * | 10/1992 | Dietl et al. | 347/89 |
| 5,719,609 | A * | 2/1998 | Hauck et al. | 347/85 |
| 5,923,353 | A * | 7/1999 | Boyd et al. | 347/85 |
| 6,030,074 | A * | 2/2000 | Barinaga | 347/85 |
| 6,116,723 | A * | 9/2000 | Childers | 347/85 |
| 6,164,742 | A * | 12/2000 | Hauck | 347/6 |
| 6,203,146 | B1 * | 3/2001 | Pawlowksi et al. | 347/85 |
| 6,213,598 | B1 * | 4/2001 | Hou et al. | 347/86 |
| 6,494,568 | B2 | 12/2002 | Hou et al. | |
| 6,685,307 | B2 | 2/2004 | Dowell et al. | |
| 6,840,605 | B2 | 1/2005 | Hauck | |
| 7,467,858 | B2 | 12/2008 | Lebron et al. | |

(Continued)

FOREIGN PATENT DOCUMENTS

| | | |
|---|---|---|
| CN | 1353042 | 6/2002 |
| CN | 200981378 | 11/2007 |

(Continued)

OTHER PUBLICATIONS

PCT Search Report/Written Opinion—PCT/US2010/034272 dated Jan. 20, 2011.

(Continued)

*Primary Examiner* — Alessandro Amari
*Assistant Examiner* — Michael Konczal
(74) *Attorney, Agent, or Firm* — Rathe Lindenbaum LLP; Todd Rathe

(57) ABSTRACT

A liquid supply (30, 130, 330) includes a lever (48, 348) that moves in response to expansion and contraction of a variable chamber (42, 342) within a liquid reservoir (56, 356). Movement of the lever (48, 348) moves a ball (52, 352) or sealing member (154, 354) to open or close an opening (60, 360) out of the liquid reservoir (56, 356).

20 Claims, 8 Drawing Sheets

(56) References Cited

U.S. PATENT DOCUMENTS

| | | | | |
|---|---|---|---|---|
| 2003/0202072 | A1 | 10/2003 | Childs et al. | |
| 2004/0165039 | A1 | 8/2004 | Dietl | |
| 2004/0257412 | A1* | 12/2004 | Anderson et al. | 347/85 |
| 2007/0081052 | A1 | 4/2007 | Lebron et al. | |
| 2007/0222828 | A1 | 9/2007 | Stathem et al. | |
| 2008/0303879 | A1* | 12/2008 | Nip | 347/86 |
| 2009/0219366 | A1 | 9/2009 | Silverbrook et al. | |

FOREIGN PATENT DOCUMENTS

| | | | | |
|---|---|---|---|---|
| CN | 101143516 | | 3/2008 | |
| CN | 201105537 | | 8/2008 | |
| CN | 101437685 | | 5/2009 | |
| EP | 0794059 | B1 | 1/2002 | |
| EP | 1449665 | | 8/2004 | |
| JP | 1988-256451 | | 10/1988 | |
| JP | 1993-203066 | | 8/1993 | |
| JP | 1997-193414 | | 7/1997 | |
| JP | 2000-033711 | | 12/2000 | |
| JP | 2003-326738 | | 11/2003 | |
| JP | 2006-523812 | | 10/2004 | |
| JP | 2011-051271 | * | 3/2011 | B41J 2/175 |

OTHER PUBLICATIONS

EPO, "Supplemental Search Report," issued in connection with European Patent Application No. 10851498, dated Feb. 4, 2013 (2 pages).

* cited by examiner

LIQUID SUPPLY

BACKGROUND

Liquid supplies may utilize one or more valves to address back pressure during dispensing of liquid. Such valves may be complex, space consuming and unreliable.

DETAILED DESCRIPTION OF THE EXAMPLE EMBODIMENTS

Figure 1:
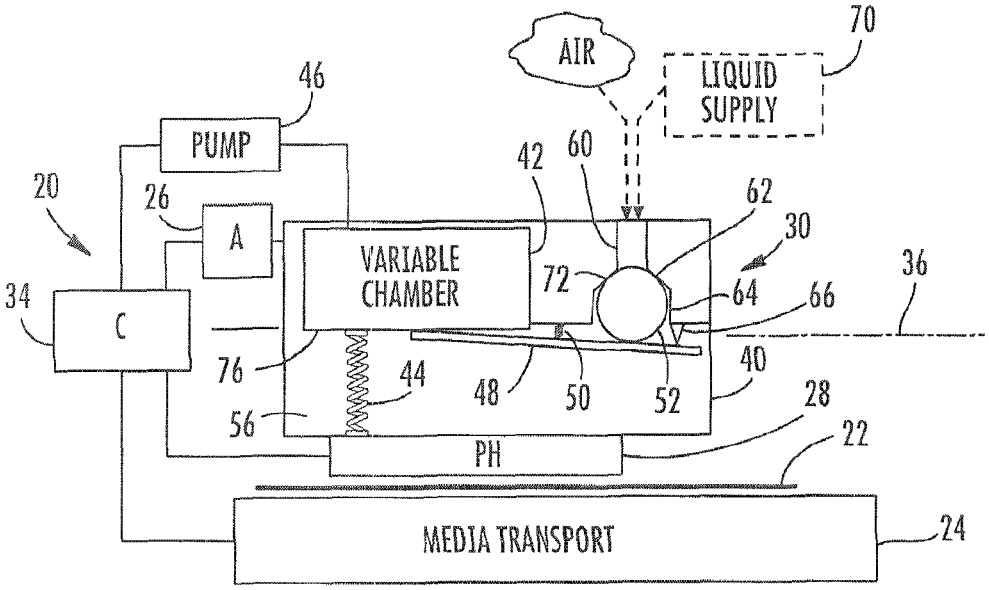
FIG. 1 is a schematic illustration of a liquid deposition system having a liquid supply with a valve arrangement as a pressure regulator in a closed state according to an example embodiment.

FIG. 1 schematically illustrates liquid deposition system 20 according to an example embodiment. Liquid deposition system 20 deposits a liquid or solution upon a substrate or medium. In the example illustrated, liquid deposition system 20 comprises an imaging or printing system configured to print patterns, text or images upon a print medium 22. In other embodiments, liquid deposition system 20 may deposit liquids in other manners. As will be described hereafter, liquid deposition system 20 includes a liquid supply having a valve arrangement that regulates pressure in compact, less expensive and reliable fashion.

Liquid deposition system 20 includes media transport 24, actuator 26, liquid ejectors 28, liquid supply 30 and controller 34. Media transport 24 comprises a mechanism configured to position a substrate or print medium 22 opposite and with respect to liquid ejectors 28. In one embodiment, media transport 24 may be configured to position a web of print media, such as a web of paper, opposite to liquid ejectors 28. In another embodiment, media transport 24 may be configured to position or index individual sheets of print media opposite to liquid ejectors 28. Media transport 24 may move and position such substrate or print media using any one of a combination of belts, rollers, cylinders or drums and the like.

Actuator 26 comprises a mechanism configured to move, scan or reciprocate liquid ejectors 28 back and forth along axis 36 and across substrate or media 22 positioned by media transport 24. In the example illustrated in which liquid ejectors 28 are supported or carried by liquid supply 30, actuator 26 moves or scans both liquid ejectors 28 and liquid supply 30, as a unit, across or substantially across the media or substrate 22 positioned by media transport 24. In one embodiment, actuator 26 may comprise a motor driven shaft which drives a flexible cable, belt or the like connected to a carriage (not shown) supporting liquid supply 30 and ejectors 28 to move the liquid supply 30 and liquid electors 28 across the substrate or medium 22. In another embodiment, actuator 26 may have other configurations. In other embodiments, actuator 26 may be omitted. For example, in embodiments where ejectors 28 comprise a page-wide-array of ejectors or where media transport 28 sufficiently positions media 22 with respect to ejectors 28, actuator 26 may be omitted.

Liquid ejectors 28 comprise structures configured to selectively eject or dispense liquid onto a substrate or print medium. Liquid ejectors 28 receive liquid from liquid supply 30. As liquid ejectors 28 draw liquid from liquid supply 30 back pressures may be created within liquid supply 30. In the example illustrated, liquid ejectors 28 comprise one or more print heads directly connected to liquid supply 30. Examples of liquid ejectors 28 include, but are not limited to thermal resistance print heads. Piezo resistance print heads and the like. In other embodiments, liquid ejectors 28 may be indirectly connected to or coupled to liquid supply 28 through additional conduits, passages, tubes and the like.

Liquid supply 30 supplies liquid, such as ink or other solutions, to liquid ejectors 28. Liquid supply 30 includes housing 40, variable chamber 42, bias 44, pump 46, lever 48, bias 50 and ball 52. Housing 40 comprises one or more structures which enclose and form an internal chamber, volume or liquid reservoir 56. In one embodiment, housing 40 is configured as a cartridge which forms the reservoir 56 for containing ink. Housing 40 additionally includes or forms opening 60, seat 62, ball alignment guide 64 and one or more fulcrums 66.

Opening 60 comprises a conduit or passage extending from the interior of housing 40 (liquid reservoir 56) to an exterior of housing 40, outside of housing 40. In one embodiment, opening 60 is connected to atmosphere, allowing air to enter reservoir 56 through opening 60 when opening 60 is open or unblocked. In another embodiment, opening 60 is connected to a separate liquid supply 70, allowing liquid, such as ink, to enter reservoir 56 through opening 60. For example, in one embodiment, liquid supply 70 may comprise a larger independent reservoir of liquid or may comprise an off-axis liquid or a supply connected to opening 60 by a tube or other liquid delivery structure. Although opening 60 is schematically illustrated as being substantially linear, opening 60 may have a variety of sizes, shapes, lengths and configurations.

Seat 62 comprises one or more surfaces about opening 60 configured to contact a sealing member (ball 52 in liquid supply 30). Seat 62 cooperates with a sealing member (ball 52) to form a seal across opening 60 when the sealing member is in contact with seat 62. Seat 62 may have multiple shapes and sizes depending upon the size and shape of the sealing member. In one embodiment, seat 62 may include a surface 72 sized, shaped and located so as to contact the sealing member, wherein the surface 72 is formed from a hydrophobic material. In one embodiment, surface 72 may be integrally formed as part of housing 40 or may be provided by a ring or other separate structure secured about opening 60. In those embodiment in which surface 72 is hydrophobic, opening 60 has a lower bubble pressure. In other embodiments, surface 72 may be formed from other materials so as to not be hydrophobic.

Ball alignment guide 64 comprises one of more structures configured to guide movement of ball 52 towards and away from seat 62 and opening 60. Guide 64 facilitates alignment of ball 52 with seat 62 and across opening 60. In the example illustrated, guide 64 comprises a recess, detent or cavity that movably receives at least a portion of ball 52 to inhibit lateral movement of ball 52 to such an extent that ball 52 no longer extends across opening 60 or no longer adequately contacts surface 72 to seal across opening 60. In other embodiments, guide 64 may have other configurations.

Fulcrum 66 comprises a support or point of rest on which lever 48 turns or pivots. Fulcrum 66 is sized and located such that lever 40 may be pivoted or turned about fulcrum 66 to an extent such that the sealing member, ball 52, may be moved away from opening 60 so as to open, unblock or unseal opening 60. In other embodiments, fulcrum 66 may be replaced with other structures or mechanisms that pivotally support lever 48 with respect to the sealing member (ball 52). For example, lever 48 may alternatively be hinged to housing 40.

Variable chamber 42 comprises a chamber or enclosed volume within the reservoir 56 and within housing 40 that has at least one flexible, bendable or stretchable wall coupled to lever 48 such that expansion or contraction of the chamber 42 and movement of the wall exerts a force upon lever 48, pivoting lever 48 about fulcrum 64. In the example illustrated, chamber 42 has a bendable, flexible or stretchable wall 76 that moves to expand, contract or change the shape of chamber 42 so as to move lever 48. For example, in one embodiment, wall 76 of chamber 42 may comprise a flexible partition or membrane. In other embodiments, chamber 42 may include additional flexible or stretchable walls, wherein the volume of chamber 42 may be increased or decreased or wherein the volume may remain the same, but the shape of chamber 42 changes to exert a force upon and move lever 48.

Bias 44 comprises one or more springs configured to resist or control the expansion or shape changing of wall 76 and chamber 42. In the example illustrated, bias 44 comprises a compression spring. In other embodiments, bias 44 may comprise other forms of springs or may be omitted.

Pump 46 comprises a pump connected to an interior of chamber 42 so as to selectively inflate and deflate chamber 42. In the embodiment illustrated, pump 46 is configured to supply pressurized air to the interior chamber 42 so as to inflate chamber 42 to hyper inflate chamber 42 such that the interior of reservoir 56 has a positive pressure. Such hyperinflation of chamber 42 facilitates the expulsion of liquid through ejectors 28 to prime liquid ejectors 28. In some embodiments, pump 46 may be omitted.

Lever 48 comprises a substantially inflexible or rigid bar or elongate member extending across fulcrum 66, across ball 52 and in contact with or operably coupled to wall 76 of chamber 42. Lever 48 allows a relatively small amount of force resulting from the movement of wall 76 to move lever 48. In one embodiment, lever 48 has a length and is located with respect to fulcrum 66 and bias 50 to provide a 7 to 1 force magnification.

In one embodiment, lever 48 is forced from stamped metal. In another embodiment, lever 48 may be formed from rigid or substantially rigid polymers or other materials. Lever 48 is movable in response to expansion, contraction or a change in shape of chamber 42 and movement or stretching of wall 76. Although illustrated as being linear or extending in a plane, lever 48 may include bends and the like. In one embodiment, lever 48 may include one or more rounded portions or dimples in contact with either or both of wall 76 or ball 52.

Bias 50 comprises one or more springs configured to resiliently bias or urge lever 48 towards opening 60, towards ball 52 and towards surface 76 of chamber 42. Bias 50 urges lever 48 against ball 52 to resiliently bias ball 52 towards seat 62 and towards a position which ball 52 blocks, closes or seals opening 60. In the example illustrated, bias 50 comprises a tension spring attached to each of them between housing 40 and lever 48. In other embodiments, bias 50 may comprise a compression spring between housing 40 and lever 48. In one embodiment, bias 50 may comprise one or more springs integrally formed as part of single unitary body with housing 40 or integrally formed as part of a single unitary body with lever 48.

Ball 52 comprises a spherical member between lever 48 and opening 60, wherein ball 52 is movable between a first position (shown in FIG. 1) in which opening 60 is sealed and a second position (shown in FIG. 2) in which the opening 60s unsealed or opened. In one embodiment, ball 52 is linearly translatable between the first position and the second position. In the arrangement shown in FIG. 1, ball 52 serves as a sealing member to seal or close opening 60. In one embodiment, ball 52 has an outer rubber or elastomeric or compressible surfaces, allowing ball 52 to conform against seat 62 for enhanced sealing. In another embodiment, ball 52 may be relatively hard and smooth, wherein surface 72 is elastomeric or compressible for enhanced mating contact or sealing between ball 52 and seat 62. In such embodiments, the compressibility or elastomeric nature of ball 52 and/or seat 62 allows the valve arrangement provided by ball 52 and seat 62 to overcome imperfections in the sealing surfaces and to further be impact resistant, inhibiting or minimizing air intrusion into reservoir 56 upon impacts or external forces to liquid supply 30. In yet other embodiments, both ball 52 and seat 62 may be elastomeric or both ball 52 and seat 62 may be incompressible and smooth. In some embodiment, ball 52 may include an outer hydrophobic surface to facilitate separation of ball 52 from seat 62 and from lever 48 upon inflation or expansion of chamber 42 or movement of wall 76. For purposes of this disclosure when referring to seat 62, surface 72 or the surface of ball 52, the term "compressible" or "elastomeric" means that the surface will change shape or resiliently deform in response to the forces applied by lever 48 upon ball 52 against seat 62, in one embodiment less than or equal to about 200 g of force and nominally less than or equal to about 100 g of force.

Controller 34 comprises one or more processing units configured to generate control signals directing and controlling the operation of liquid deposition system 20 (shown as a printer). For purposes of this application, the term "processing unit" shall mean a presently developed or future developed processing and that excretes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 34 may be embodied as part of one or more application-specific integrated circuits (ASICs). Unless otherwise specifically noted, the controller is not limited to any specific combination of hardware circuitry and software, nor to any particular source for the instructions executed by the processing unit.

In the embodiment illustrated, controller 34 generates control signals directing media transport 24 to position a substrate or printed medium 22 with respect to liquid ejectors 28. Controller 34 further generates control signals directing liquid ejectors 28 to selectively deposit the liquid upon the substrate or printed medium 22. In embodiments where liquid supply 30 is scanned across print medium 22, controller 34 may also generate control signals directing such movement by controlling actuator 26. To facilitate use of the ejectors 28, controller 34 may also generate control signals directing pump 46 to hyper inflate chamber 42 to prime such ejectors 28. In other embodiments, controller 34 may control a greater or fewer of such functions associated with liquid deposition system 20.

Figure 2:
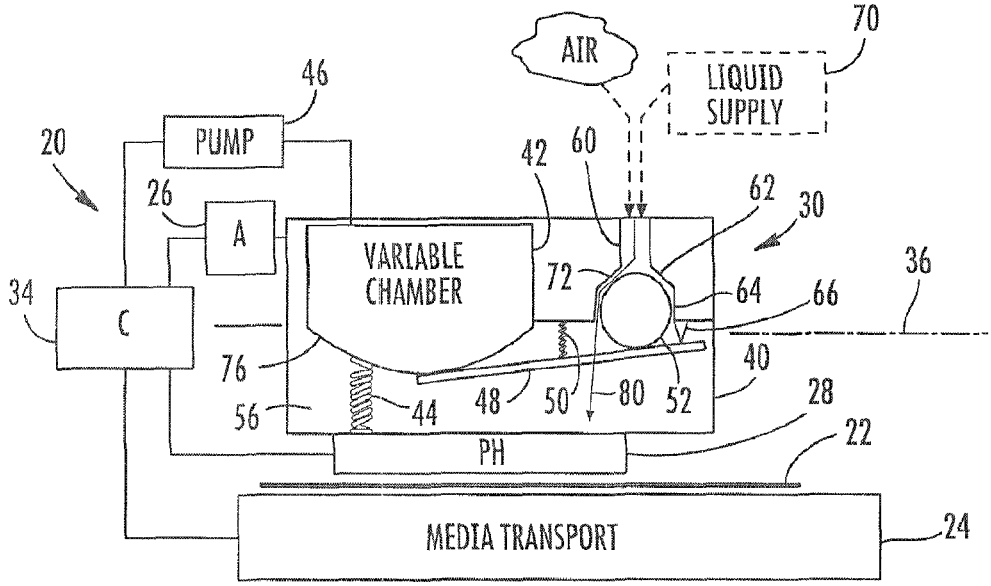
FIG. 2 is a schematic illustration of the liquid deposition system of FIG. 1 illustrating the valve arrangement as the pressure regulator in an open state according to an example embodiment.
Figure 2A:
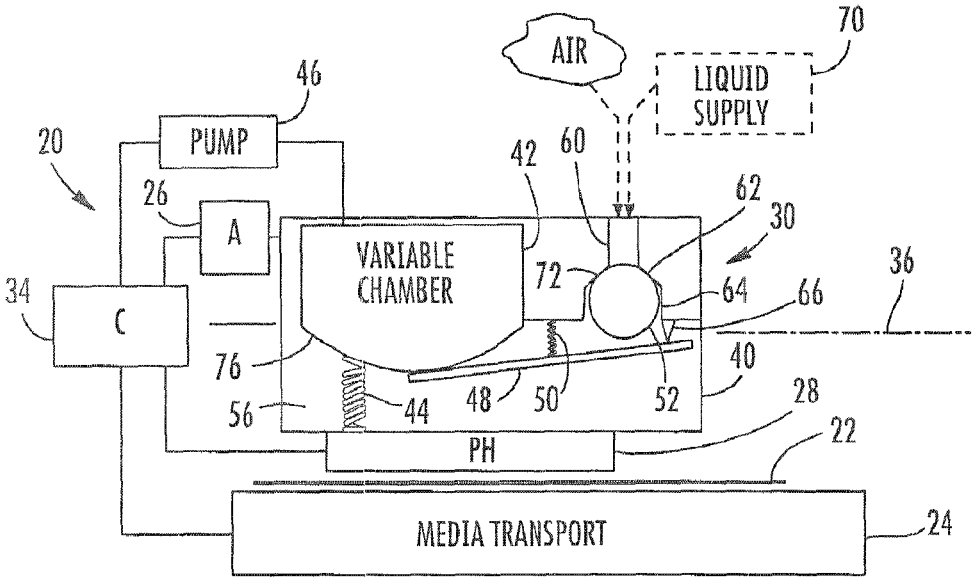
FIG. 2A is a schematic illustration of the liquid deposition system of FIG. 1 illustrating the valve arrangement as a check valve according to an example embodiment.

FIGS. 1, 2 and 2A further illustrate operation of liquid supply 30. FIG. 1 illustrates the valve arrangement provided by lever 48 and ball 52 serving as a pressure regulator and in a closed or sealed state closing opening 60. FIG. 2 illustrates the valve arrangement provided by lever 48 and ball 52 serving as a pressure regulator and in an open state. FIG. 2A illustrates liquid supply 30 during priming of electors 28, wherein ball 52 serves as a check valve.

In the states shown in FIGS. 1 and 2, lever 48 and ball 52 function as a pressure regulator, opening and closing opening 60 based upon pressure within interior 56 to regulate the pressure within interior 56. In the state shown in FIG. 1, any negative or back pressure within interior 56 is insufficient to substantially move wall 76 against bias 44 and against bias 50. In other words, any negative or backpressure currently existing in interior 56 is not large enough to move lever 48 a sufficient distance such that ball 52 may move away from seat 62. As a result, bias 50 continues to resiliently urge lever 48 against fulcrum 66 and against ball 52 such that ball 52 is urged against and info sealing contact with seat 62 across opening 60. In one embodiment, the force exerted upon ball 52 by lever 48 is approximately 100 g or 1 Newton. In other embodiments, the force may have other values depending upon the characteristics of ball 52 and seat 62 and the expected pressures exerted upon ball 52 through opening 60. In one embodiment, chamber 42 is vented to atmosphere when lever 48 and ball 52 are functioning as a pressure regulator to regulate pressure within interior 56.

FIG. 2 illustrates liquid supply 30 allowing the entry of liquid (from liquid supply 70) or air into interior 56 (as indicated by arrow 80) in response to a negative or back pressure within interior 56. As a result, the valve arrangement provided by lever 48 and ball 52 reduces or eliminates backpressure. Such negative pressure or back pressure may be the result of a previous withdrawal of liquid from reservoir 56. As shown in FIG. 2, the back pressure within reservoir 56 causes wall 76 of chamber 42 to expand further into reservoir 56 such movement of wall 76 pivots lever 48 about fulcrum 66 (or about a hinge or other pivot point in other embodiments) against the bias of bias 50. As a result, the back pressure within reservoir 56 urging ball 52 away from opening 60 and away from seat 62 becomes greater than the remaining forces urging ball 52 towards opening 60 and towards seat 62. Consequently, ball 52 moves away from opening 60, allowing air (in one embodiment) or liquid (in another embodiment) to enter reservoir 56 as indicated by arrow 80. Air or liquid flows into reservoir 56 until the back pressures within reservoir 56 become small enough such that wall 76 moves back towards the position or state shown in FIG. 1, allowing lever 48, under the force of bias 50, to return to state shown in FIG. 1, urging ball 52 back towards the first position and once again closing or sealing opening 60. Thus, chamber 42, lever 48, ball 52 and biases 44 and 50 serve to regulate pressure within reservoir 56.

FIG. 2A illustrates the valve arrangement provided by lever 48 and ball 52 serving as check valve during priming of ejectors 28. During such priming of ejectors 28, chamber 42 is no longer vented to atmosphere, but is inflated or hyper inflated by pump 46. In particular, pump 46 hyper inflates chamber 42, moving or stretching wall 76. As a result, wall 76 pivots lever 48 about fulcrum 66 (or about a hinge or other pivot point in other embodiments) against the bias of bias 50. Lever 48 no longer urges ball 52 towards opening 60 and towards seat 62.

Hyperinflation of chamber 42 further increases pressure within interior 56 so as to drive or force liquid, such a ink, to ejectors 28. The increased pressure within interior 56 forces ball 52 against seat 62, such that ball 52 functions as a check valve closing opening 60. In some embodiments in which port 60 is connected to an external liquid supply 70, the external supply 70 may also provide additional liquid through port or opening 60 to serve as an additional source of pressure to push liquid or ink to ejectors 28. In such embodiment, the additional liquid supplied through port or opening 60 to assist in priming of ejectors 28 is supplied at a pressure greater than the pressure within interior 56 so as to move ball 52 away from seat 62 to open opening 60.

At the end of priming, chamber 42 is permitted to deflate back to the state shown FIG. 1. In one embodiment, chamber 42 is once again vented to atmosphere (the exterior of supply 30). As a result, the valve arrangement provided by lever 48 and ball 52 once again serves as a pressure regulator, either closing port 60 as shown in FIG. 1 or opening port 60 as shown in FIG. 2 depending upon the existence or extent of any backpressure within interior 56.

Figure 3:
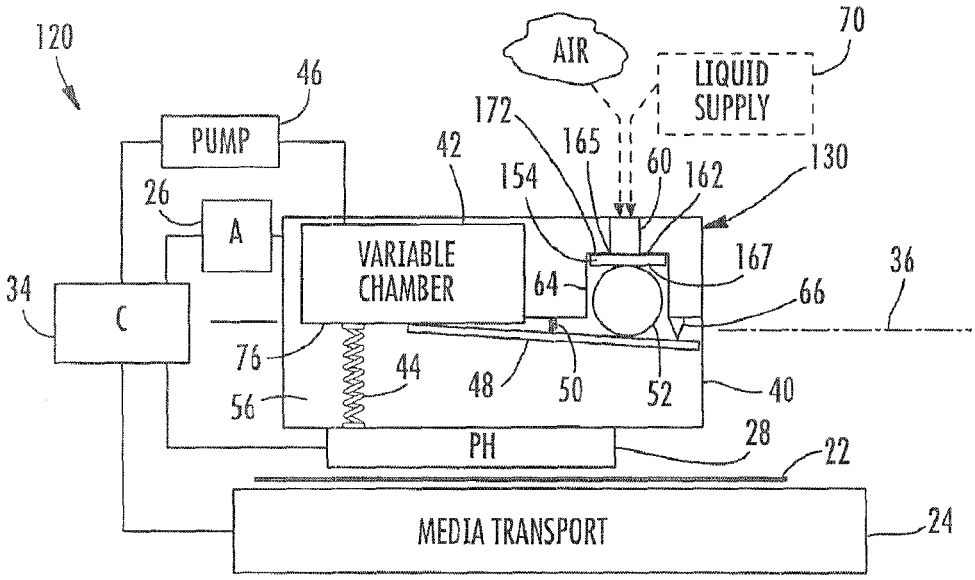
FIG. 3 is a schematic illustration of another embodiment of the liquid deposition system of FIG. 1 having another embodiment of the liquid supply with a valve arrangement as a pressure regulator in a closed state according to an example embodiment.
Figure 4:
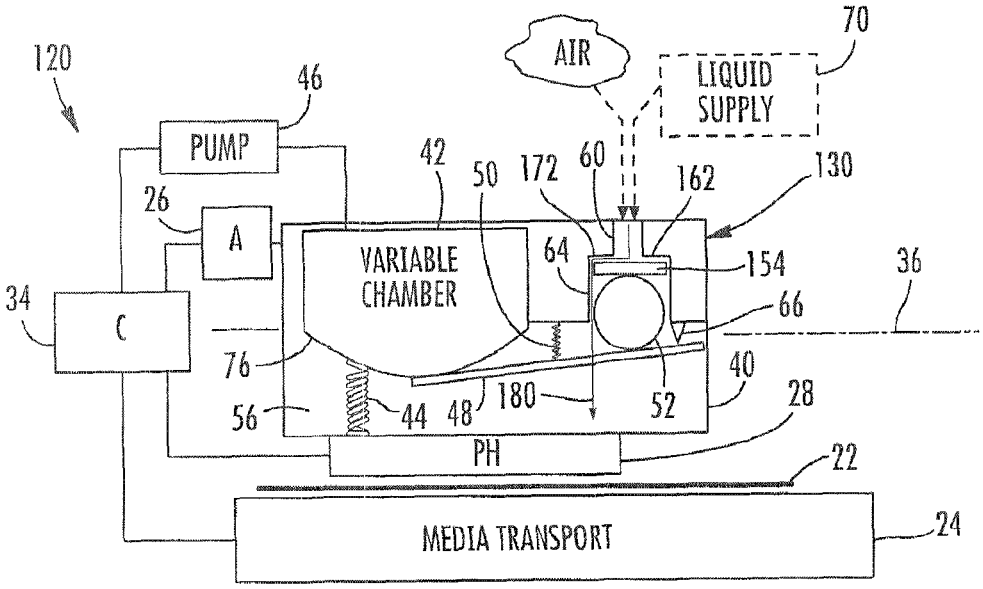
FIG. 4 is a schematic illustration of the liquid deposition system of FIG. 3 illustrating the valve arrangement as the pressure regulator in a first open state according to an example embodiment.

FIGS. 3 and 4 schematically illustrate liquid deposition system 120, another embodiment of liquid deposition system 20 shown in FIGS. 1 and 2. Liquid deposition system 120 is similar to liquid deposition system 20 except that liquid deposition system 120 includes liquid supply 130 in place of liquid supply 30. Liquid supply 130 is similar to liquid supply 30 except that liquid supply 130 includes seat 162 in place of seat 62 and additionally includes sealing member 154. Those remaining elements of liquid deposition system 120 which correspond to elements of liquid deposition system 20 are numbered similarly.

Seat 162 is similar to seat 62 except that seat 162 is configured to cooperate with sealing member 154 (rather than ball 52) to form a seal so as to block, close or occlude opening 60 when sealing member 154 is positioned against and in contact with seat 162. In the example illustrated, seat 162 is illustrated as a substantially flat, planar surface about opening 60 and perpendicular to the axis of opening 60. In other embodiments, seat 162 may alternatively have other configurations depending upon the opposite mating surfaces of sealing member 154.

In one embodiment, seat 162 may include a surface 172 sized, shaped and located so as to contact the sealing member, wherein the surface 172 is formed from a hydrophobic material. In one embodiment, surface 172 may be integrally formed as part of housing 40 or may be provided by a ring or other separate structure secured about opening 60. In those embodiment in which surface 172 is hydrophobic, opening 60 has a lower bubble pressure. In other embodiments, surface 172 may be formed from other materials so as to not be hydrophobic.

Sealing member 154 comprises a member extending across opening 60 and captured between ball 52 and opening 60. Sealing member 154 is movable between a sealed position (shown in FIG. 3), sealing or blocking opening 60, and an unsealed position (shown in FIG. 4), spaced from opening 60 to allow air (in one embodiment) or liquid (in another embodiment) to flow past sealing member 154 and enter reservoir 56. In the example illustrated, sealing member 154 is linearly translatable between the sealed position and the unsealed position.

According to one embodiment, sealing member 154 includes an outer hydrophobic surface 165 facing seat 162 to facilitate separation of member 154 from seat 162. In one embodiment, seat 154 may additionally or alternatively include an outer hydrophobic surface 167 facing ball 52 to facilitate separation of ball 52 from sealing member 154. In one embodiment, in addition to being hydrophobic or as an alternative to being hydrophobic, surface 165 of sealing member 154 may be rubber-like or elastomeric to facilitate sealing against seat 162. For purposes of this disclosure when referring to surfaces 165, 167 or surface 172, the term "compressible" or "elastomeric" means that the surface will change shape or resiliently deform in response to the forces applied by lever 48 upon ball 52 against sealing member 154 and against seat 162, in one embodiment less than or equal to about 200 g of force and nominally less than or equal to about 100 g of force.

In the embodiment illustrated in FIGS. 3 and 4, sealing member 154 comprises a substantially rigid, inflexible flat, planar plate or disk. In other embodiments, sealing member 154 may have other shapes and configurations. For example, sealing member 154 may have a wider transverse dimension extending more closely towards or into contact with opposing sides of guide 64, wherein guide 64 guides movement of sealing member 154 towards and away from opening 60 and maintains sealing member 154 fully across opening 60.

Figure 4A:
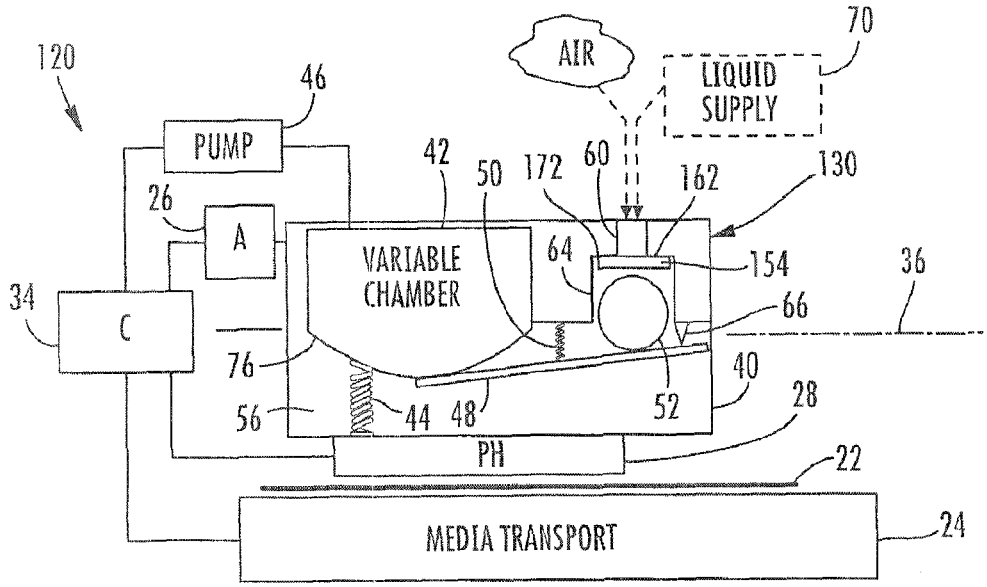
FIG. 4A is a schematic illustration of the liquid deposition system of FIG. 4 illustrating the valve arrangement as a check valve according to an example embodiment.

FIGS. 3, 4 and 4A further illustrate operation of liquid supply 130. FIG. 3 illustrates the valve arrangement provided by lever 48, ball 52 and sealing member 154 serving as a pressure regulator and in a closed or sealed state closing opening 60. FIG. 4 illustrates the valve arrangement provided by lever 48, ball 52 and sealing member 154 serving as a pressure regulator and in an open state. FIG. 4A illustrates liquid supply 130 during priming of ejectors 28, wherein sealing member 154 serves as a check valve.

In the states shown in FIGS. 3 and 4, lever 48, ball 52 and sealing member 154 function as a pressure regulator, opening and closing opening 60 based upon pressure within interior 56 to regulate the pressure within interior 56. In the state shown in FIG. 3, any negative or back pressure within interior 56 is insufficient to substantially move wall 76 against bias 44 and against bias 50. In other words, any negative or backpressure currently existing in interior 56 is not large enough to move lever 48 a sufficient distance such that ball 52 and sealing member 154 may move away from seat 162. As a result, bias 50 continues to resiliently urge lever 48 against fulcrum 66 and against ball 52 such that sealing member 154 is urged against and into sealing contact with seat 162 across opening 60. In one embodiment, the force exerted upon ball 52 by lever 48 is approximately 100 g or 1 Newton. In other embodiments, the force may have other values depending upon the characteristics of sealing member 154 and seat 62 and the expected pressures exerted upon sealing member 154 through opening 60. In one embodiment chamber 42 is vented to atmosphere when lever 48, ball 52 and sealing member 154 are functioning as a pressure regulator to regulate pressure within interior 56.

FIG. 4 illustrates liquid supply 130 allowing the entry of liquid (from liquid supply 70) or air into interior 56 (as indicated by arrow 180) in response to a negative or back pressure within interior 56. As a result, the valve arrangement provided by lever 48 and ball 52 reduces or eliminates backpressure. Such negative pressure or back pressure may be the result of a previous withdrawal of liquid from reservoir 56. As shown in FIG. 4, the back pressure within reservoir 56 causes wall 76 of chamber 42 to expand further info reservoir 56 such movement of wall 76 pivots lever 48 about fulcrum 66 for about a hinge or other pivot point in other embodiments) against the bias of bias 50. As a result, the back pressure within reservoir 56 urging ball 52 away from opening 60 and away from seat 62 becomes greater than the remaining forces urging ball 52 towards opening 60 and sealing member 154 towards seat 62. Consequently, sealing member 154 moves away from opening 60, allowing air (in one embodiment) or liquid (in another embodiment) to enter reservoir 56 as indicated by arrow 180. Air or liquid flows into reservoir 56 until the back pressures within reservoir 56 become small enough such that wall 76 moves back towards the position or state shown in FIG. 3, allowing lever 48, under the force of bias 50, to return to the state shown in FIG. 3, urging ball 52 back towards the first position and sealing member 154 against seat 162 once again closing or sealing opening 60. Thus, chamber 42, lever 48, ball 52, sealing member 154 and biases 44 and 50 serve to regulate pressure within reservoir 56.

FIG. 4A illustrates the valve arrangement provided by lever 48, ball 52 and sealing member 154 serving as a check valve during priming of ejectors 28. During such priming of ejectors 28, chamber 42 is no longer vented to atmosphere, but is inflated or hyper in listed by pump 46. In particular, pump 46 hyper inflates chamber 42, moving or stretching wall 76. As a result, wall 76 pivots lever 48 about fulcrum 66 (or about a hinge or other pivot point in other embodiments) against the bias of bias 50. Lever 48 no longer urges ball 52 towards opening 60 and sealing member 154 towards seat 62.

Hyperinflation of chamber 42 further increases pressure within interior 56 so as to drive or force liquid, such as ink, to ejectors 28. The increased pressure within interior 56 forces sealing member 154 against seat 162, such that sealing member 154 functions as a check valve closing opening 66. In some embodiments in which port 60 is connected to an external liquid supply 70, the external supply 70 may also provide additional liquid through port or opening 60 to serve as an additional source of pressure to push liquid or ink to ejectors 28. In such embodiments, the additional liquid supplied through port or opening 60 to assist in priming of ejectors 28 is supplied at a pressure greater than the pressure within interior 56 so as to move sealing member 154 away from seat 162 to open opening 60.

At the end of priming, chamber 42 is permitted to deflate back to the state shown FIG. 3. In one embodiment, chamber 42 is once again vented to atmosphere (the exterior of supply 130). As a result, the valve arrangement provided in part by lever 48, ball 52 and sealing member 154 once again serves as a pressure regulator, either closing port 60 as shown in FIG. 3 or opening port 60 as shown in FIG. 4 depending upon the existence or extent of any backpressure within interior 56.

Figure 5:
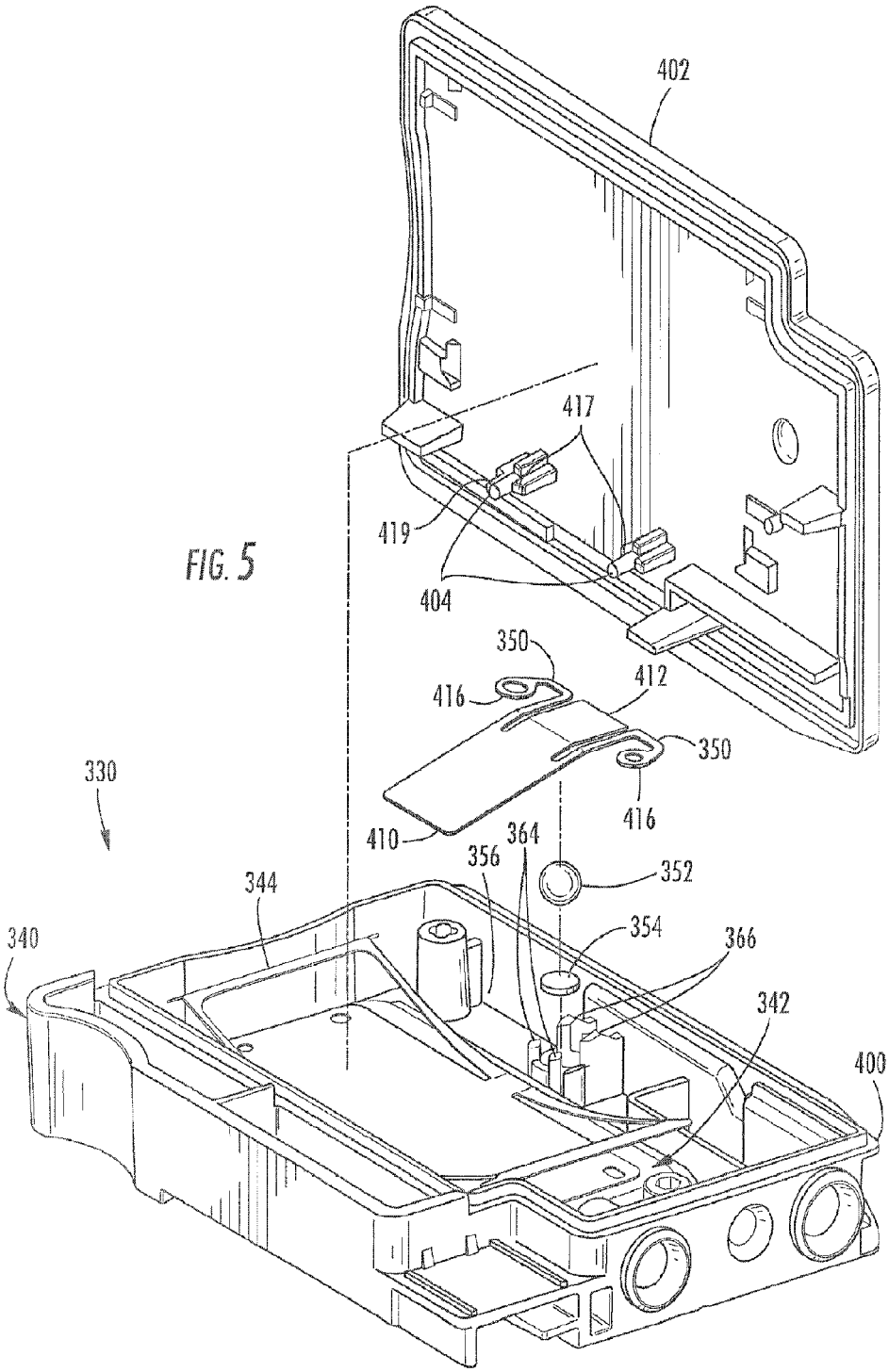
FIG. 5 is an exploded perspective view of another embodiment of the liquid supply of FIG. 1 according to example embodiment.
Figure 6:
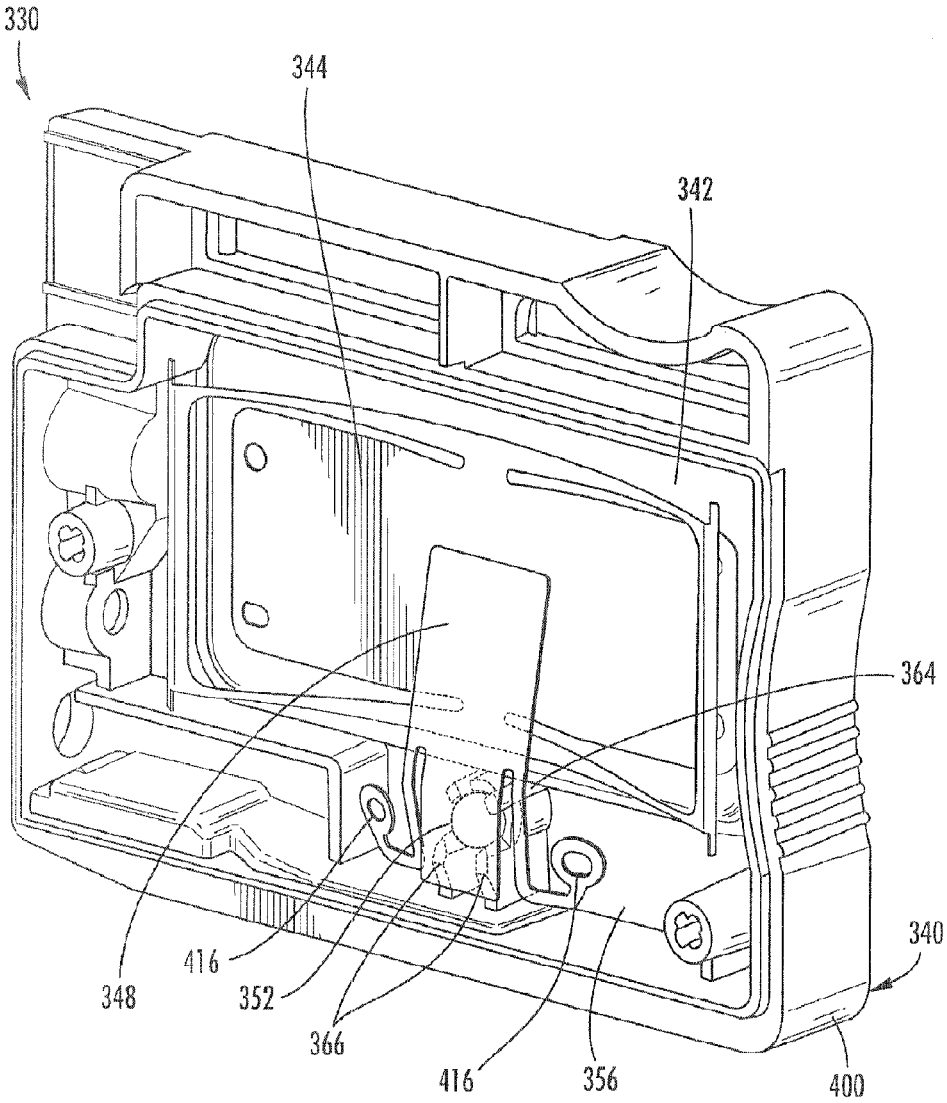
FIG. 6 is a perspective view of the liquid supply of FIG. 5 with a lid removed according to example embodiment.
Figure 7:
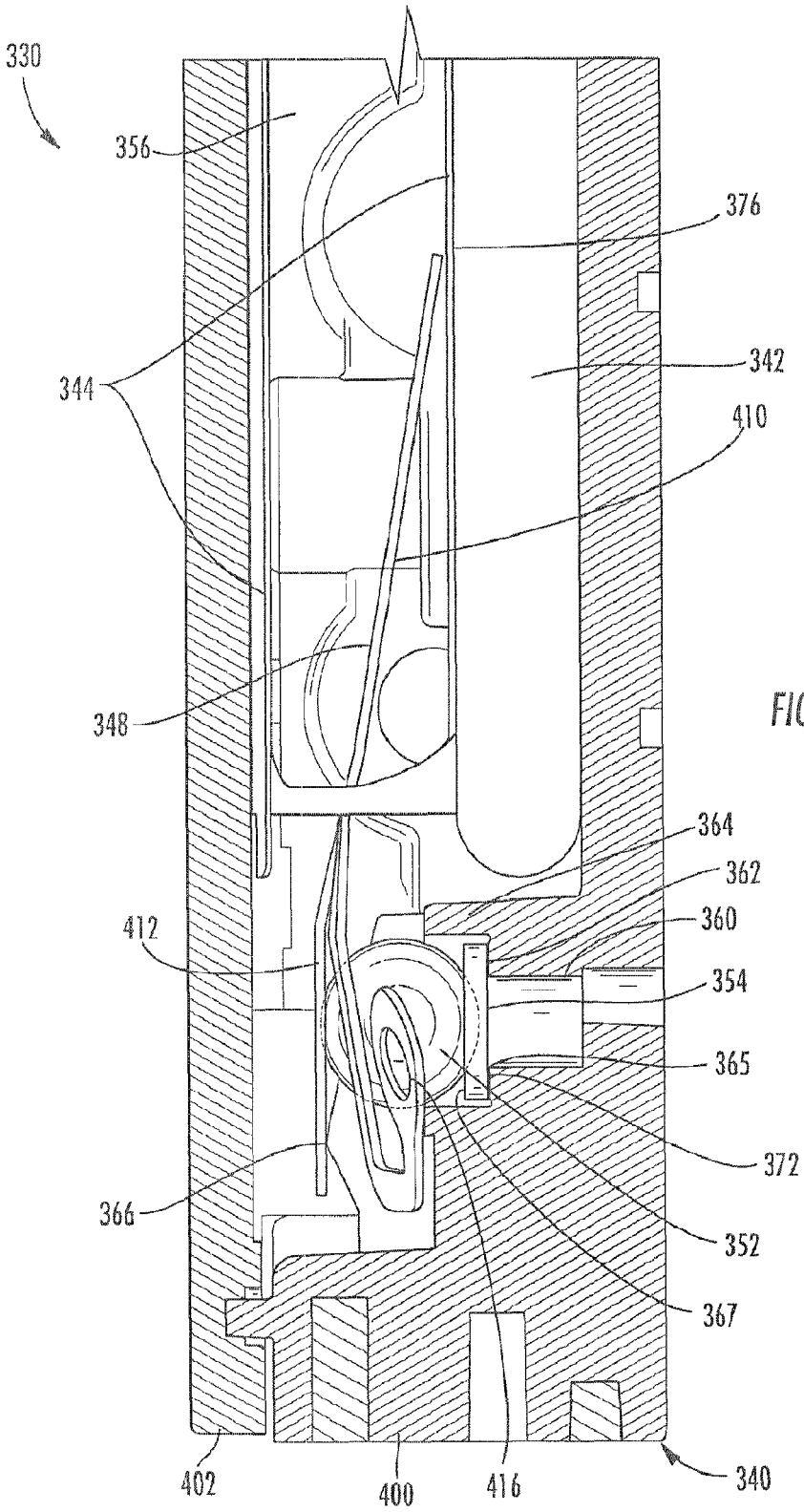
FIG. 7 is a fragmentary sectional view of the liquid supply of FIG. 5 with a valve arrangement in a closed state according to an example embodiment.

FIGS. 5-8 illustrate liquid supply 330, another embodiment of liquid supply 30. According to one embodiment, liquid supply 330 is utilized in place of liquid supply 30 in FIG. 1 or liquid supply 130 in FIG. 3. As with liquid supplies 30 and 130, liquid supply 330 supplies liquid, such as ink or other solutions, to liquid ejectors 28 (shown in FIGS. 1 and 3) which are connected to supply 330. Liquid supply 330 includes housing 340, variable chamber 342, bias 344, pump 46 (schematically shown in FIGS. 1 and 3) pneumatically connected to an interior of chamber 342, lever 348, bias 350, ball 352 and sealing member 354. Housing 340 comprises one or more structures which enclose and form an internal chamber, volume or liquid reservoir 356. In the embodiment illustrated, housing 340 is configured as a cartridge which forms the reservoir 356 for containing ink. In the example illustrated, housing 340 includes a clam-shell shaped main portion 400 and a lid 402 which, when joined, enclose interior 356. As shown by FIGS. 6 and 7, main portion 400 includes or forms opening 360, seat 362, ball alignment guide 364 and fulcrums 366.

Opening 360 comprises a conduit, channel or passage extending from the interior of housing 340 (liquid reservoir 356) to an exterior of housing 340, outside of housing 340. In one embodiment, opening 360 is connected to atmosphere, allowing air to enter reservoir 356 through opening 360 when opening 360 is open or unblocked. In another embodiment, opening 360 is connected to a separate liquid supply 70 (shown in FIGS. 1 and 3), allowing liquid, such as ink, to enter reservoir 356 through opening 360. Although opening 360 is schematically illustrated as being substantially linear, opening 360 may have a variety of sizes, shapes, lengths and configurations.

Seat 362 comprises one or more surfaces about opening 360 configured to contact sealing member 354. Seat 362 cooperates with scaling member 354 to form a seal across opening 360 when the sealing member 354 is in contact with seat 362. Seat 362 may have multiple shapes and sizes depending upon the size and shape of the sealing member. In one embodiment, seat 362 may include a surface 372 sized, shaped and located so as to contact the sealing member, wherein the surface 372 is formed from a hydrophobic material. In the embodiment illustrated, surface 372 is integrally formed as part of housing 340. In other embodiments, surface 372 may be provided by a ring or other separate structure secured about opening 360. In those embodiment in which surface 372 is hydrophobic, opening 360 has a lower bubble pressure. In other embodiments, surface 372 may be formed from other materials so as to not be hydrophobic.

Ball alignment guide 364 comprises one of more structures configured to guide movement of ball 352 towards and away from seat 362 and opening 360. Guide 364 facilitates alignment of ball 352 with seat 362 and in contact with sealing member 354 across opening 360. In one embodiment, a minimum gap of 0.2 mm is provided between edges of sealing member 354 and opposite surfaces of guide 364. In the example illustrated, sealing member 354 has a diameter of at least 0.4 mm less than the inner diameter of the opening between opposite guides 364. Because guide 364 is spaced from sealing member 354, in those embodiments where air enters through opening 360, the air may more easily flow past the sealing member 354 and past the ball 352 with less likelihood of a meniscus forming which might otherwise add to back pressure within interior 356.

In the example illustrated, guide 364 comprises a plurality of angularly spaced fingers or prongs receiving at least a portion of ball 352 to inhibit lateral movement of ball 352 to such an extent that ball 352 no longer extends across opening 360 or no longer adequately contacts sealing member 354 to press sealing member 554 across opening 360. Because guide 364 comprises prongs, ribs, corners or other structures angularly spaced from one another about ball 352 and sealing member 354 (rather than a continuous cylinder), in those embodiments where air enters through opening 360, the air may more easily flow past the sealing member 354 and past the ball 352 with less likelihood of a meniscus forming which might otherwise add to back pressure within interior 356. In other embodiments, guide 364 may have other configurations.

Fulcrums 366 comprise supports or points of rest on which lever 348 turns, slides and/or pivots. Fulcrums 366 are sized and located such that lever 348 may be pivoted or turned about fulcrums 366 to an extent such that the sealing member 354 and ball 352, may be moved away from opening 360 so as to open, unblock or unseal opening 360.

As shown by FIG. 6, in the example illustrated, fulcrums 366 include a pair of fulcrums located on opposite sides of ball 352 such that lever 348 is contacted at three distinct spaced points. In the example illustrated, such points are arranged as points of a triangle with the two fulcrums 366 serving as the base corners of the triangle and the ball 352 serving as the apex of the triangle. Because fulcrums 366 are spaced apart from one another on opposite sides of ball 352, fulcrums 366 more stably support and orient lever 348 across ball 352 without hinges or similar devices. In one embodiment, two thirds of the force exerted by lever 348 is applied to ball 352 and a third of the force is shared between fulcrums 366. In other embodiments, the number of fulcrums 366, their relative locations and the distribution of forces may be varied. In other embodiments, fulcrums 366 may be replaced with other structures or mechanisms that pivotally support lever 348 with respect to ball 352. For example, lever 348 may alternatively be hinged to housing 340.

Lid 402 closes off the interior of housing 340. In the example illustrated, lid 462 includes a pair of mounting posts 404 for securing lever 348 and bias 350. In the example illustrated, mounting posts 404 have angled faces 417 that contact the leaf springs around the openings of the mounting ears 416 at the angle of the ears 416. In one embodiment, faces 417 are at an angle of about 15 degrees. In the example illustrated, faces 417 are located on a line intersecting both posts 404 and on a side of the associated post 404 closest to the other post 404. As a result, posts 404 consistently interact with bias 350 during deflection of cars 416 and variations in the ratio of force on ball 352 to the force on fulcrums 366 is reduced. In one embodiment, the ratio of force on ball 352 to the force on fulcrums 366 is about 3 to 1.

As further shown by FIG. 5, one of posts 404 includes a keying portion 419. Keying portion 419 has a corresponding non-circular opening in one of ears 416, wherein portion 419 inhibits incorrect mounting of bias 350 onto posts 404. In other embodiments, lid 402 may have other configurations.

Variable chamber 342 comprises a chamber or enclosed volume within the reservoir 356 and within housing 340 that has at least one flexible, bendable or stretchable wall coupled to lever 348 such that expansion or contraction of the chamber 342 and movement of the wall exerts a force upon lever 348, pivoting lever 348 about fulcrums 366. In the example illustrated, chamber 342 has a bendable, flexible or stretchable wall 376 that moves to expand, contract or change the shape of chamber 342 sides to move lever 348. In the example illustrated, chamber 342 comprises a flexible bag. In other embodiments, chamber 342 may comprise an inflexible, rigid container having at least one side formed by the flexible or stretchable wall 376. For example, in one embodiment, wall 376 of chamber 342 may comprise a flexible partition or membrane. In other embodiments, chamber 342 may include additional flexible or stretchable walls, wherein the volume of chamber 342 may be increased or decreased or wherein the volume may remain the same, but the shape of chamber 342 changes to exert a force upon and move lever 348.

Bias 344 comprises a spring configured to resist or control the expansion or shape changing of wall 376 and chamber 342. In the example illustrated, bias 344 comprises a compression leaf spring captured between wall 376 and the lid 402. In other embodiments, bias 344 may comprise other forms of springs or may be omitted.

Lever 348 comprises a substantially inflexible or rigid bar or elongate member extending across fulcrums 366, across ball 352 and in contact with or operably coupled to wall 376 of chamber 342. Lever 348 allows a relatively small amount of force resulting from the movement of wall 376 to move lever 348. In the example illustrated, lever 348 has a length and is located with respect to fulcrums 366 and bias 350 to provide a 7 to 1 force magnification.

In the example illustrated, lever 348 is formed from stamped metal. In another embodiment, lever 348 may be formed from rigid or substantially rigid polymers or other materials. Lever 348 is movable in response to expansion, contraction or a change in shape of chamber 342 and movement or stretching of wall 376. As shown by FIG. 7, lever 348 has a first portion 410 obliquely extending from surface 376 of chamber 342 and a second portion 412 bent or obliquely extending from first portion 410 so as to extend substantially parallel to sealing member 354 and substantially perpendicular to an axial centerline of opening 360 centered through ball 352. As a result, alignment of forces on ball 352 and sealing member 354 are enhanced. In other embodiments, lever 348 may alternatively be linear or extend in a plane. In one embodiment, lever 348 may include one or more rounded portions or dimples in contact with either or both of wall 370 and ball 352.

Bias 350 comprises one or more springs configured to resulting bias or urge lever 348 towards opening 360, towards ball 352 and towards surface 376 of chamber 342. Bias 350 urges lever 348 against ball 352 to resiliency bias ball 352 towards sealing member 354 against seat 362 in which sealing member 354 blocks, closes or seals opening 360. In the example illustrated, bias 350 comprises a pair of leaf springs between housing 340 and lever 348. In the example illustrated, the pair of leaf springs are integrally formed as a single unitary body with lever 348. Each leaf spring includes a mounting ear 416 which mounts upon a corresponding post 404 of lid 402. The geometry is such that force is applied to the mounting ears 416 is below (towards opening 360) ball 352 and above (away from opening 360) fulcrums 366. As a result, stability is enhanced. In the example illustrated, bias 350 has a shape or geometry so as to extend away or onward from (not overlap) chamber 342 or bias 344. As a result, movement of was 376 of chamber 342 and bias 344 is not unduly hindered. In other embodiments, bias 350 may have other configurations.

In other embodiments, bias 350 may comprise other mechanisms and may be attached to housing 360 and lever 348 in other fashions. For example, in other embodiments, bias 350 may comprise a tension spring attached to each of them between housing 340 and lever 348. In other embodiments, bias 50 may comprise a compression spring between housing 40 and lever 48.

Ball 352 composes a spherical member between lever 348 and opening 360, wherein ball 352 is movable between a first position (shown in FIG. 7) in which opening 360 is sealed by means of intermediate sealing member 354 and a second position (shown in FIG. 8) in which the opening 360 is unsealed or opened. In one embodiment, ball 352 is linearly translatable between the first position and the second position.

Sealing member 354 comprises a member extending across opening 360 and captured between ball 352 and opening 360. Sealing member 354 is movable between a sealed position (shown in FIG. 7), sealing or blocking opening 360, and an unsealed position (shown in FIG. 8), spaced from opening 360 to allow air (in one embodiment) or liquid (in another embodiment) to flow past sealing member 354 and enter reservoir 356. In the example illustrated, sealing member 354 is linearly translatable between the sealed position and the unsealed position.

According to one embodiment, sealing member 354 includes an outer hydrophobic surface 365 facing seat 362 to facilitate separation of member 354 from seat 362. In one embodiment, seat 354 may additionally or alternatively include an outer hydrophobic surface 367 facing ball 352 to facilitate separation of ball 352 from sealing member 354. In one embodiment, in addition to being hydrophobic or as an alternative to being hydrophobic, surface 365 of sealing member 354 may be rubber-like or elastomeric to facilitate sealing against seat 362. As a result, sealing member 354 compresses or stretches to accommodate imperfections in the opposing surfaces to form an enhanced seal.

For purposes of this disclosure when referring to surfaces 365, 367 or surface 372, the term "compressible" or "elastomeric" means that the surface will change shape or resiliently deform in response to the forces applied by lever 348 upon ball 352 against sealing member 354 and against seat 362, in one embodiment less than or equal to about 200 g of force and nominally less than or equal to about 100 g of force. In one embodiment, sealing member 354 comprises an elastomeric disc formed from a synthetic rubber such as ethylene propylene diene monomer (EPDM). In other embodiments, sealing member 354 may be formed from other materials.

In the illustrated embodiment, sealing member 354 comprises a substantially rigid, inflexible flat, planar plate or disk having a transverse dimension extending closely towards or into contact with opposing sides of guide 364, wherein guide 364 guides movement of sealing member 354 towards and a away from opening 360 and maintains sealing member 354 fully across opening 360. In other embodiments, sealing member 354 may have other shapes and configurations.

Figure 8:
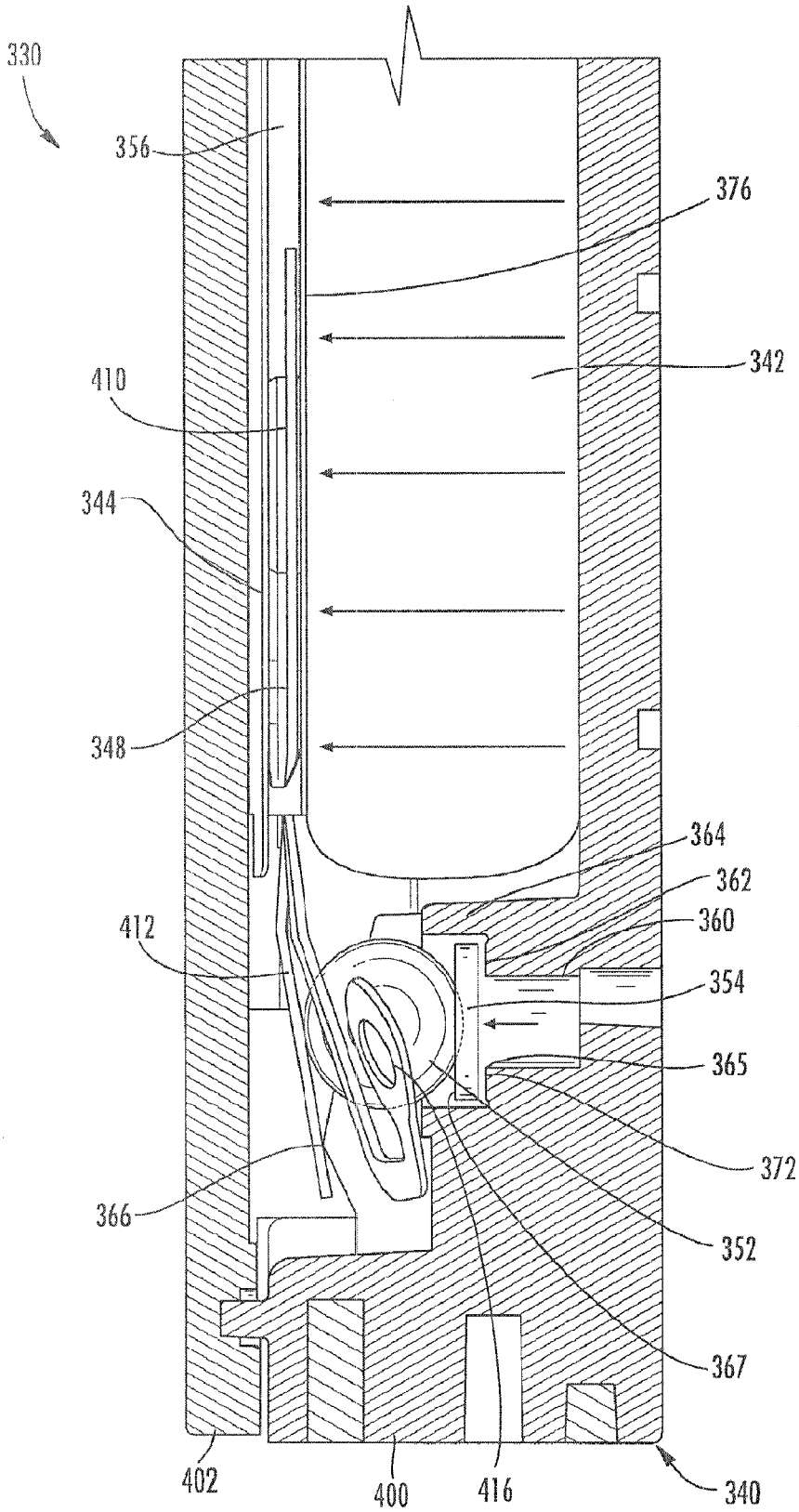
FIG. 8 is a fragmentary sectional view of the liquid supply of FIG. 5 with the valve arrangement as a pressure regulator in an open state according to an example embodiment.
Figure 8A:
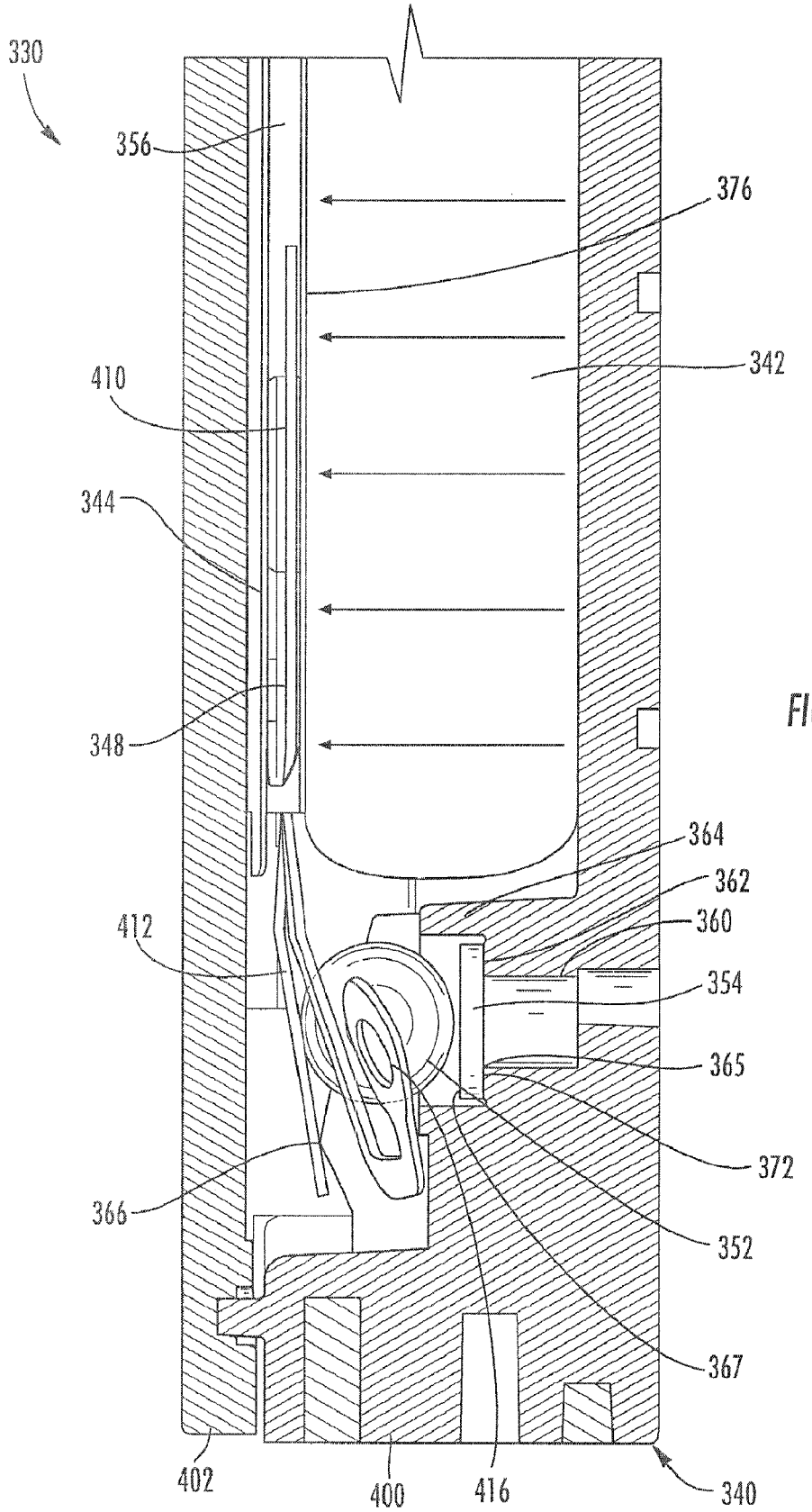
FIG. 8A is a fragmentary sectional view of the liquid supply of FIG. 5 with the valve arrangement as a check valve according to an example embodiment.

FIGS. 7, 8 and 8A further illustrate operation of liquid supply 330. FIG. 7 illustrates the valve arrangement provided by lever 348, ball 352 and sealing member 354 serving as a pressure regulator and to a closed or sealed state closing opening 360. FIG. 8 illustrates the valve arrangement provided by lever 348, ball 352 and sealing member 354 serving as a pressure regulator and in an open state. FIG. 8A illustrates liquid supply 330 during priming of ejectors 28 (shown in FIGS. 1 and 3), wherein sealing member 354 serves as a check valve.

In the states shown in FIGS. 7 and 8, lever 348, ball 352 and sealing member 354 function as a pressure regulator, opening and closing opening 360 based upon pressure within interior 356 to regulate the pressure within interior 356. In the state shown in FIG. 7, any negative or back pressure within interior 356 is insufficient to substantially move wall 376 against bias 344 and against bias 350. In other words, any negative or backpressure currently existing in interior 356 is not large enough to move lever 348 a sufficient distance such that ball 352 and sealing member 354 may move away from seat 362. As a result, bias 350 continues to resiliently urge lever 348 against fulcrum 366 against ball 352 such that sealing member 354 is urged against and into sealing contact with seat 362 across opening 360. In one embodiment, the force exerted upon ball 352 by lever 348 is approximately 100 g or 1 Newton. In other embodiments, the force may have other values depending upon the characteristics of sealing member 354 and seat 362 and the expected pressures exerted upon sealing member 354 through opening 360. In one embodiment, chamber 342 is vented to atmosphere when lever 348, ball 352 and sealing member 354 are functioning as a pressure regulator to regulate pressure within interior 356.

FIG. 8 illustrates liquid supply 330 showing the entry of liquid (from liquid supply 70 shown in FIGS. 1 and 3) or air into interior 356 in response to a negative or back pressure within interior 356. As a result, the valve arrangement provided by lever 348 and ball 352 reduces or eliminates backpressure. Such negative pressure or back pressure may be the result of a previous withdrawal of liquid from reservoir 356. As shown in FIG. 8, the back pressure within reservoir 356 causes wall 376 of chamber 342 to expand further into reservoir 356 such movement of wall 376 pivots lever 348 about fulcrums 366 (or about a hinge or other pivot point in other embodiments) against the bias of bias 350. As a result, the back pressure within reservoir 356 urging ball 352 away from opening 360 and away from seat 362 becomes greater than the remaining forces urging ball 352 towards opening 360 and sealing member 154 towards seat 362. Consequently, sealing member 354 moves away from opening 360, allowing air (in one embodiment) or liquid (in another embodiment) to enter reservoir 356. Air or liquid flows into reservoir 356 until the back pressures within reservoir 356 become small enough such that wall 376 moves back towards the position or state shown in FIG. 7, allowing lever 348, under the force of bias 350, to return to the state shown in FIG. 7, urging ball 352 back towards the first position and sealing member 354 against seat 362 once again closing or sealing opening 360. Thus, chamber 342, lever 348, ball 352, sealing member 354 and biases 344 and 350 serve to regulate pressure within reservoir 356.

FIG. 8A illustrates the valve arrangement provided by lever 348, ball 352 and sealing member 354 serving as a check valve during priming of ejectors 28 (schematically shown in FIGS. 1 and 3). During such priming of ejectors 28, chamber 342 is no longer vented to atmosphere, but is inflated or hyper inflated by pump 46 (Schematically shown in FIGS. 1 and 3). In particular, pump 346 hyper inflates chamber 342, moving or stretching wall 376. As a result, wall 376 pivots lever 348 about fulcrum 366 (or about a hinge or other pivot point in other embodiments) against the bias of bias 350. Lever 348 no longer urges ball 352 towards opening 360 and sealing member 354 towards seat 362.

Hyperinflation of chamber 342 further increases pressure within interior 356 so as to drive or force liquid, such as ink, to ejectors 28. The increased pressure within interior 356 forces sealing member 354 against seat 362, such that sealing member 354 functions as a check valve closing opening 360. In some embodiments in which port 360 is connected to an external liquid supply 70 (schematically shown in FIGS. 1 and 3), the external supply 70 may also provide additional liquid through port or opening 360 to serve as an additional source of pressure to push liquid or ink to electors 28. In such embodiments, the additional liquid supplied through port or opening 360 to assist in priming of ejectors 28 is supplied at a pressure greater than the pressure within interior 356 so as to move sealing member 354 away from seat 362 to open opening 360.

At the end of priming, chamber 342 is permitted to deflate back to the state shown FIG. 7. In one embodiment, chamber 342 is once again vented to atmosphere (the exterior of supply 330). As a result, the valve arrangement provided in part by lever 348, ball 352 and sealing member 354 once again serves as a pressure regulator, either closing port 360 as shown in FIG. 7 or opening port 360 as shown in FIG. 8 depending upon the existence or extent of any backpressure within interior 56.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A liquid supply comprising:

a housing enclosing a liquid reservoir and having an opening between the liquid reservoir and outside the housing;

a variable chamber within the liquid reservoir, the variable chamber in communication with a pump to selectively inflate and deflate the variable chamber;

a lever movable in response to expansion and contraction of the variable chamber;

a ball between the lever and the opening, the ball being movable between a first position in which the opening is sealed and a second position in which the opening is unsealed;

a sealing member between the ball and the opening, the sealing member being movable to a sealed position over the opening when the ball is in the first position and an unsealed position spaced from the opening when the ball is in the second position; and a spring resiliently biasing the lever against the ball to resiliently bias the ball towards the first position.

2. The liquid supply of claim 1 further comprising a seat about the opening, wherein the sealing member contacts and seals against the seat when the ball is in the first position.

3. The liquid supply of claim 2, wherein at least one of the seat and the sealing member includes a hydrophobic surface in contact with the other of the seat and the sealing member.

4. The liquid supply of claim 1, wherein the ball includes an outer elastomeric surface.

5. The liquid supply of claim 1 wherein the sealing member is positioned across the opening.

6. The liquid supply of claim 5, wherein at least one of the sealing member and the ball includes a hydrophobic surface in contact with the other of the sealing member and the ball.

7. The liquid supply of claim 6, wherein at least one of a surface about the opening and the sealing member includes a hydrophobic surface in contact with the other of the surface about the opening and the sealing member.

8. The liquid supply of claim 1, wherein the lever is movable in a direction away from the opening a sufficient distance such that the lever is movable out of contact with the ball.

9. The liquid supply of claim 8, wherein the lever is movable in the direction away from the opening against the bias of the spring in response to expansion of the variable chamber.

10. The liquid supply of claim 8, wherein the lever is pivotable about a first fulcrum in the direction away from the opening.

11. The liquid supply of claim 10, where the lever is pivotable about a second fulcrum in the direction away from the opening, the first fulcrum and the second fulcrum located on opposite sides of the ball.

12. The liquid supply of claim 1, wherein the lever bends in a direction towards the ball such that a portion of the lever that contacts the ball extends perpendicular to the direction of the opening.

13. The liquid supply of claim 1, wherein the spring and the lever are integrally formed as a single unitary body.

14. A liquid supply comprising:

a housing enclosing a liquid reservoir and having an opening between the liquid reservoir and outside the housing;

a variable chamber within the liquid reservoir;

a lever movable in response to expansion and contraction of the variable chamber;

a ball between the lever and the opening, the ball being linearly translatable between a first position in which the opening is sealed and a second position in which the opening is unsealed;

a sealing member between the ball and the opening, the sealing member being movable to a sealed position over the opening when the ball is in the first position and an unsealed position spaced from the opening when the ball is in the second position; and a spring resiliently biasing the lever towards the opening, wherein the ball is movable to the second position after movement of the lever in response to expansion of the variable chamber.

15. The liquid supply of claim 14, wherein the ball includes an outer elastomeric surface.

16. The liquid supply of claim 14, wherein at least one of the sealing member or the ball includes a hydrophobic surface in contact with the other of the sealing member or the ball.

17. The liquid supply of claim 14, wherein at least one of a surface about the opening or the sealing member includes a hydrophobic surface in contact with the other of the surface about the opening or the sealing member.

18. The liquid supply of claim 14, wherein the lever is pivotable about a first fulcrum to move in a direction away from the opening a sufficient distance such that the lever is movable out of contact with the ball.

19. The liquid supply of claim 18, where the lever is pivotable about a second fulcrum in the direction away from the opening, the first fulcrum and the second fulcrum located on opposite sides of the ball.

20. The liquid supply of claim 14, wherein the spring and the lever are integrally formed as a single unitary body.

* * * * *